United States Patent [19]

Manaka et al.

[11] Patent Number: 4,919,094

[45] Date of Patent: Apr. 24, 1990

[54] ENGINE CONTROL APPARATUS

[75] Inventors: Toshio Manaka, Katsuta; Masami Shida, Mito; Teruji Sekozawa, Kawasaki; Shinsuke Takahashi, Yokohama, all of Japan

[73] Assignee: Hitachi, Ltd., Tokyo, Japan

[21] Appl. No.: 380,729

[22] Filed: Jul. 13, 1989

Related U.S. Application Data

[63] Continuation of Ser. No. 207,526, Jun. 16, 1988, abandoned.

[30] Foreign Application Priority Data

Jun. 17, 1987 [JP] Japan ..... 62-149224

[51] Int. Cl.[5] ..... F02D 41/12

[52] U.S. Cl. ..... 123/326; 123/493

[58] Field of Search ..... 123/325, 326, 478, 480, 123/486, 489, 492, 493, 494

[56] References Cited

U.S. PATENT DOCUMENTS

| | | | |
|---|---|---|---|
| 4,327,682 | 5/1982 | Harada | 123/326 |
| 4,452,212 | 6/1984 | Takase | 123/493 |
| 4,655,179 | 4/1987 | Kashiwagura | 123/326 |
| 4,667,631 | 5/1987 | Kinugasa | 123/325 |
| 4,694,807 | 9/1987 | Mori | 123/493 X |
| 4,696,278 | 9/1987 | Ito et al. | 123/493 |

FOREIGN PATENT DOCUMENTS

| | | |
|---|---|---|
| 0184626 | 8/1986 | European Pat. Off. . |
| 3636810 | 4/1987 | Fed. Rep. of Germany . |
| 0124033 | 8/1982 | Japan . |
| 0000341 | 1/1987 | Japan . |

*Primary Examiner*—Willis R. Wolfe

*Attorney, Agent, or Firm*—Antonelli, Terry & Wands

[57] ABSTRACT

In an engine control apparatus for controlling the amount of fuel to be supplied by calculating the amount of liquid film or fuel adhered to an intake pipe of an engine, the adhesion rate of fuel and the time constant of evaporation of fuel in a preestimating manner, the time constant of evaporation is determined on the basis of the determined amount of liquid film, the amount of suction air and an air-to-fuel ratio upon fuel cut and the adhesion rate is determined on the basis of the amount of supply of fuel, the amount of suction air and an air-to-fuel ratio upon fuel recovery.

25 Claims, 8 Drawing Sheets

ENGINE CONTROL APPARATUS

This is a continuation of Ser. No. 207,526, filed 6/16/88, now abandoned.

BACKGROUND OF THE INVENTION

The present invention relates to a fuel injection type gasoline engine, and more particularly to an air-to-fuel ratio (hereinafter referred to as A/F) control apparatus suitable for a gasoline engine for automobile.

The fuel injection type engine has considerably been used as gasoline engines for automobiles for its better controllability of A/F.

In the fuel injection type gasoline engine, a part of fuel injected from a fuel injection valve into an intake (suction) pipe adheres to the inner wall of the intake valve and/or an intake valve. In a steady state, the amount of adhered fuel is kept substantially constant. In a transient state such as an acceleration or deceleration condition, however, the amount of adhered fuel changes. Therefore, a method of merely controlling the amount of fuel to be supplied from the fuel injection valve cannot provide an accurate control of A/F in the transient state.

The conventional system, as has been disclosed in JP-B-62-341, employs a method in which in a transient driving state of engine such as an acceleration or deceleration condition, data of the supply amount of fuel is determined through an averaging operation processing and the amount of fuel to be actually supplied is corrected (increased or decreased) in accordance with a difference between the fuel supply amount data determined by the averaging operation processing and data of the fuel supply amount before the averaging operation processing. However, this conventional system has a problem that a compensation for A/F in the acceleration or deceleration condition is not sufficient since only the correction of increase or decrease based on the averaging operation processing of the fuel amount data immediately after the change to the transient driving state is made but any quantitative correction is not made.

SUMMARY OF THE INVENTION

An object of the present invention is to provide the compensation for A/F with a sufficiently high precision even immediately after the change to the transient driving state.

The above object can be achieved by determining a fuel adhesion rate and a time constant of evaporation of adhered fuel from changes of A/F immediately after a fuel cut and immediately after a fuel recovery and correcting the amount of fuel in the transient state on the basis of the determined fuel adhesion rate and time constant of evaporation.

Some of fuel injection type gasoline engines for automobiles employ a fuel cut control for the purposes of improving the cost performance of fuel and the suppression of deflation of hydrocarbon into the exhaust gas in a deceleration condition. In the engine employing the fuel cut control, however, the fuel which has adhered to an intake pipe may evaporate even immediately after a fuel cut is made. Namely, the supply of fuel is transiently continued. On the other hand, immediately after the fuel recovery is made following the state of fuel cut, a part of fuel which is supplied again, adheres to the inner wall of the intake pipe, etc. As a result, a transient delay exists until the amount of fuel supplied into a cylinder reaches a certain value. For such circumstances, if one observes changes of output A/F immediately after the fuel recovery is made and immediately after the fuel recovery is made, a change of the amount of fuel supplied into the cylinder in the transient state can be known and hence the time constant of evaporation of fuel and the adhesion rate of fuel can be determined quantitatively in a pre-estimating manner, thereby making it possible to perform an A/F control in the transient state with a high precision.

DESCRIPTION OF THE PREFERRED EMBODIMENTS

Figure 2:
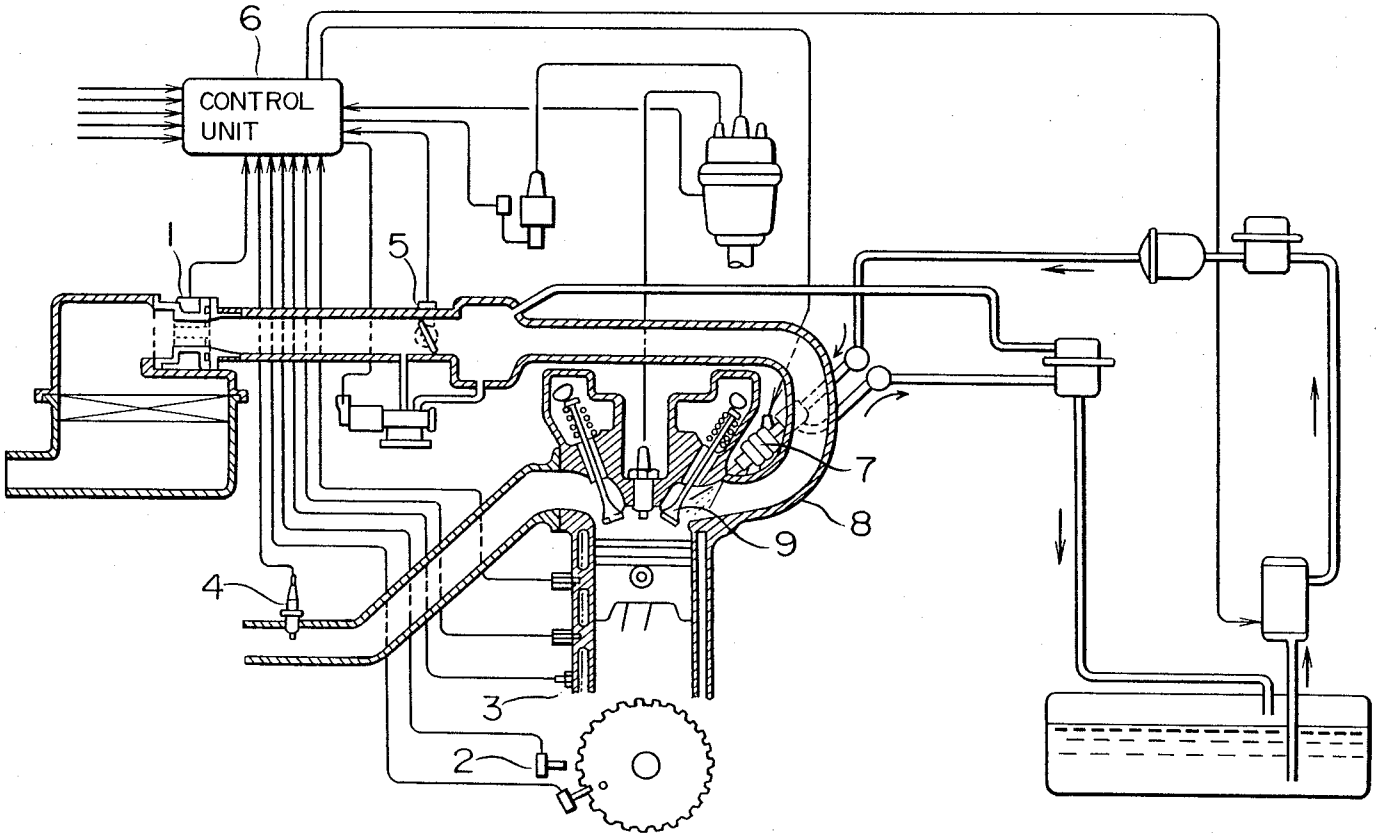
FIG. 2 is a view showing the construction of one example of an engine system to which the embodiment of the present invention is applied.

FIG. 2 shows a fuel injection type gasoline engine to which an embodiment of the present invention is applied. In FIG. 2, the amount $Q_a$ of suction air, the number N of revolutions of the engine, the temperature $T_W$ of engine cooling water, an air-to-fuel ratio (or rich-/lean signal) A/F and the opening angle $\theta_{th}$ of a throttle valve are respectively detected by an air flow sensor 1, a revolution sensor 2, a water temperature sensor 3, an A/F sensor (or $O_2$ sensor) 4 and a throttle sensor 5 which are provided in the engine. A control unit 6 determines a fuel injection pulse width $T_i$ and supplies an injection pulse signal having the pulse width $T_i$ to an injector 7 to perform a control of fuel supply amount for the engine.

Figure 3:
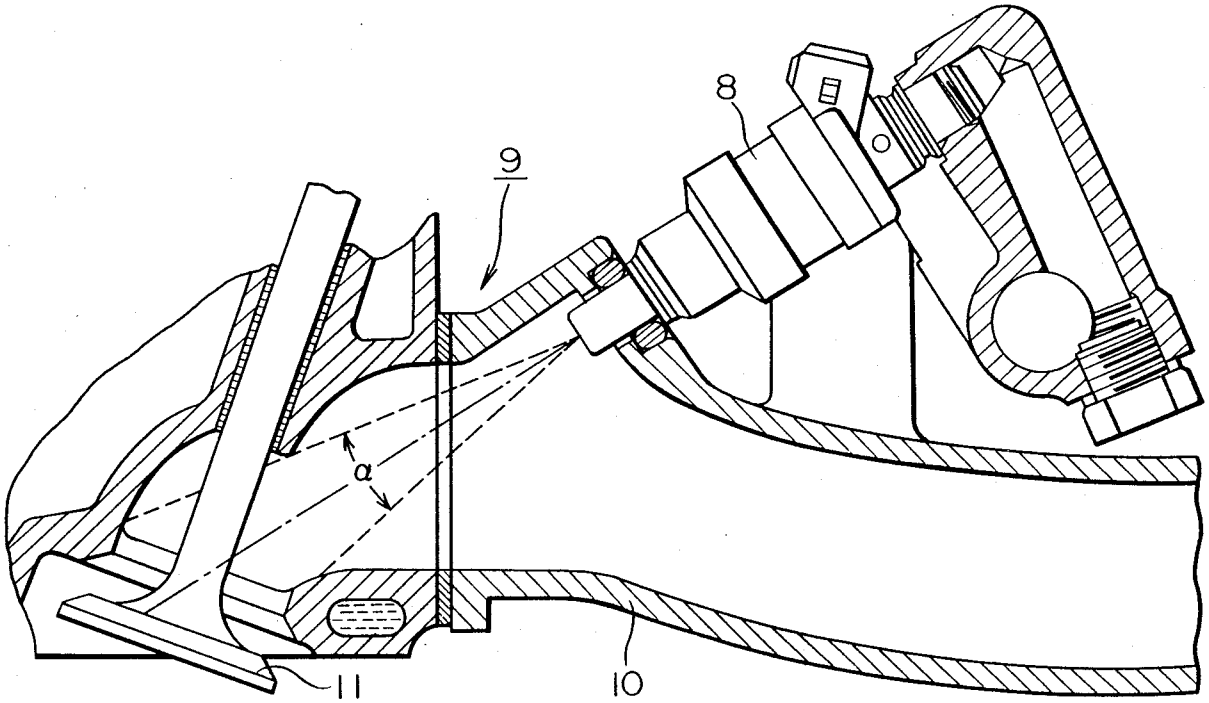
FIG. 3 is a cross-sectional view of a suction system.

FIG. 3 shows the situation of injection of fuel supplied from the injector 7 into an intake valve 9. Referring to FIG. 3, fuel is injected to the vicinity of the intake valve 9 with a spread angle of $\alpha°$. Therefore, a part of the injected fuel adheres to the inner wall of the intake valve 9 and/or an intake pipe 8. Accordingly, if this situation is left as it is, the amount of fuel actually sucked into a cylinder becomes less, thereby resulting in an insufficient A/F control which includes the occurrence of misfire upon acceleration and the resulting deterioration of controllability of driving.

Figure 4:
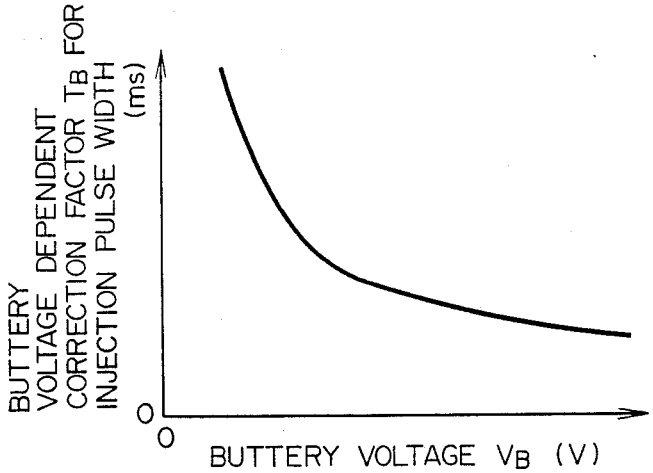
FIGS. 4 to 6 are views showing characteristic curves for control.
Figure 5:
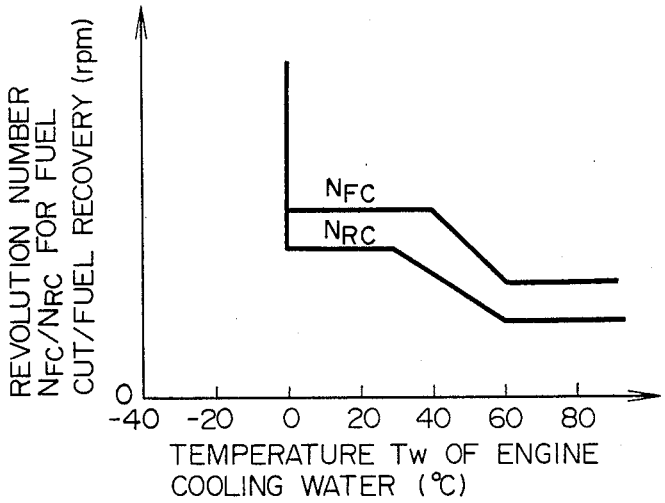
Figure 6:
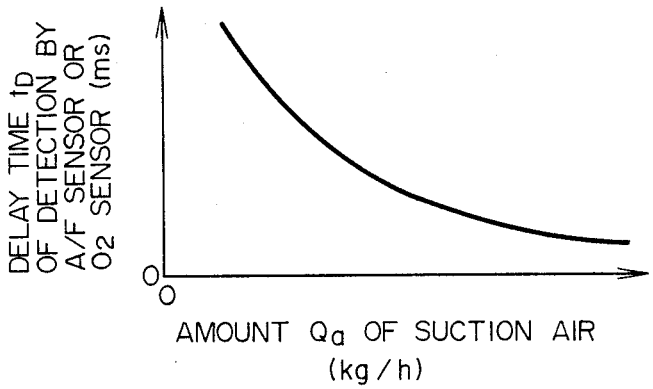

In the present embodiment, a control as will be mentioned hereinbelow is performed. Now assume that the proportion of adhered fuel to the injected fuel is X and the amount of liquid film (or the total amount of fuel adhered to the inner walls of the intake valve and intake pipe, etc.) is $M_f$. The present embodiment further takes the following factors into consideration, namely, the characteristic curve of a battery voltage dependent correction factor $T_B$ for an injection pulse width as shown in FIG. 4, the characteristic curve of a revolution number condition for enabling a fuel cut upon deceleration (see FIG. 5) and the characteristic curve of a delay time (or wasteful time) $t_D$ until upon actual change of A/F this change is detected by the A/F sensor (or $O_2$ sensor) 4 (see FIG. 6). FIG. 5 shows that a fuel cut is to be made when the number N of revolutions of the engine is larger than $N_{FC}$ and the opening angle $\theta_{th}$ of the throttle valve is approximately the fully closed state and that a fuel recovery is to be made when N is smaller than $N_{RC}$. However, it should be noted that in the case where the opening angle $\theta_{th}$ of the throttle valve is larger than a predetermined value $\theta_{idle}$, the fuel cut is not made whatever values the number N of revolutions of the engine takes.

Figure 1:
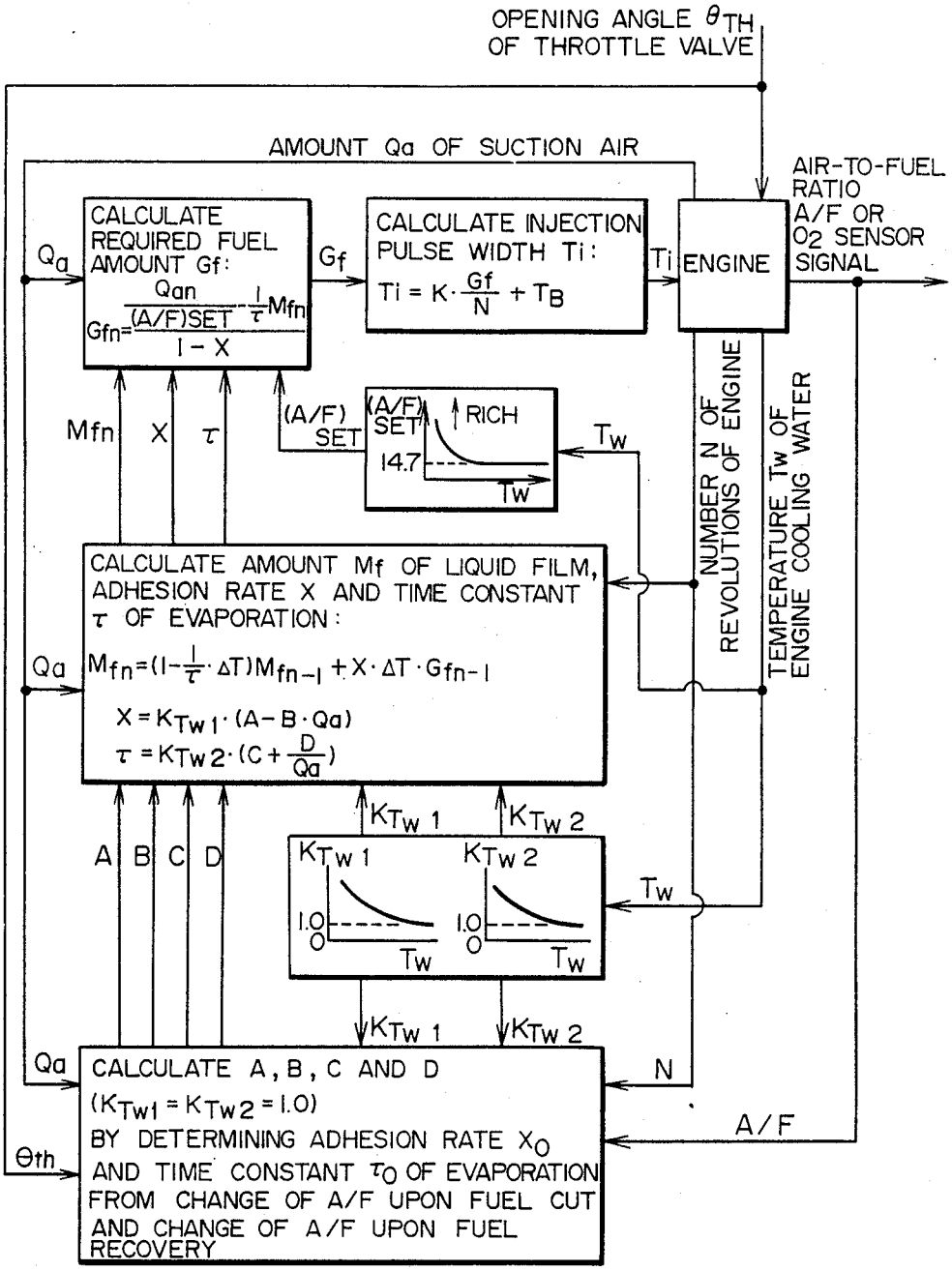
FIG. 1 shows a control block diagram of an embodiment of an A/F control apparatus according to the present invention.

FIG. 1 shows a control block diagram of the embodiment of the present invention. The opening angle $\theta_{th}$ of the throttle valve is controlled by the manipulation of an accelerator pedal by a driver so that the amount $Q_a$ of suction air, the number N of revolutions of the engine and the temperature $T_W$ of engine cooling water change. Those values are inputted to the control unit 6 which in turn calculates the amount $M_f$ of liquid film or adhered fuel, the adhesion rate X of fuel and the time constant $\tau$ of evaporation of fuel evaporating from the liquid film, estimates the amount $G_f$ of required fuel from the calculated values of $M_f$, X and $\tau$ and ultimately delivers an injection pulse $T_i$ to the injector 7.

Constants A, B, C and D necessary for determining the adhesion rate X and the time constant $\tau$ of evaporation are calculated on the basis of $X_O$ and $\tau_O$ which are obtained from the changes of A/F immediately after the fuel cut and immediately after the fuel recovery through the assumption of a mathematical model which will be explained hereinbelow.

A mathematical model of fuel transport in an intake pipe is described by "SEA Paper 810494" and can be expressed by the following equation:

$$\frac{dM_f}{dt} = X_O \cdot G_f - \frac{1}{\tau_O} M_f.$$

Immediately after the fuel cut is made, $G_f$ is 0. Therefore, the above equation can be rewritten as follows:

$$\frac{dM_f}{dt} = -\frac{1}{\tau_O} M_f.$$

Since the fuel is cut off, the amount of fuel supplied into the cylinder is equal to the amount of fuel evaporated from the adhered fuel. Accordingly, a relation of $$\frac{dM_f}{dt} = -\left(\frac{Q_a}{A/F}\right) = -\frac{1}{\tau_O} M_f$$

is satisfied. From this relation, $\tau_O$ is detectable as $$\tau_O = \frac{M_f}{\left(\frac{Q_a}{A/F}\right)}.$$

On the other hand, immediately after the fuel recovery is made, $M_f$ is 0. Therefore, one would obtain $$\frac{dM_f}{dt} = X_O \cdot G_f.$$

Upon fuel recovery, the amount of adhered fuel is zero and hence the fuel supplied from the injector is to be entirely supplied into the cylinder. Accordingly, a relation of $$\frac{dM_f}{dt} = \left(G_f - \frac{Q_a}{A/F}\right) = X_O \cdot G_f$$

is satisfied. From this relation, $X_O$ is detectable as $$X_O = \left(\frac{G_f - \frac{Q_a}{A/F}}{G_f}\right).$$

Figure 7:
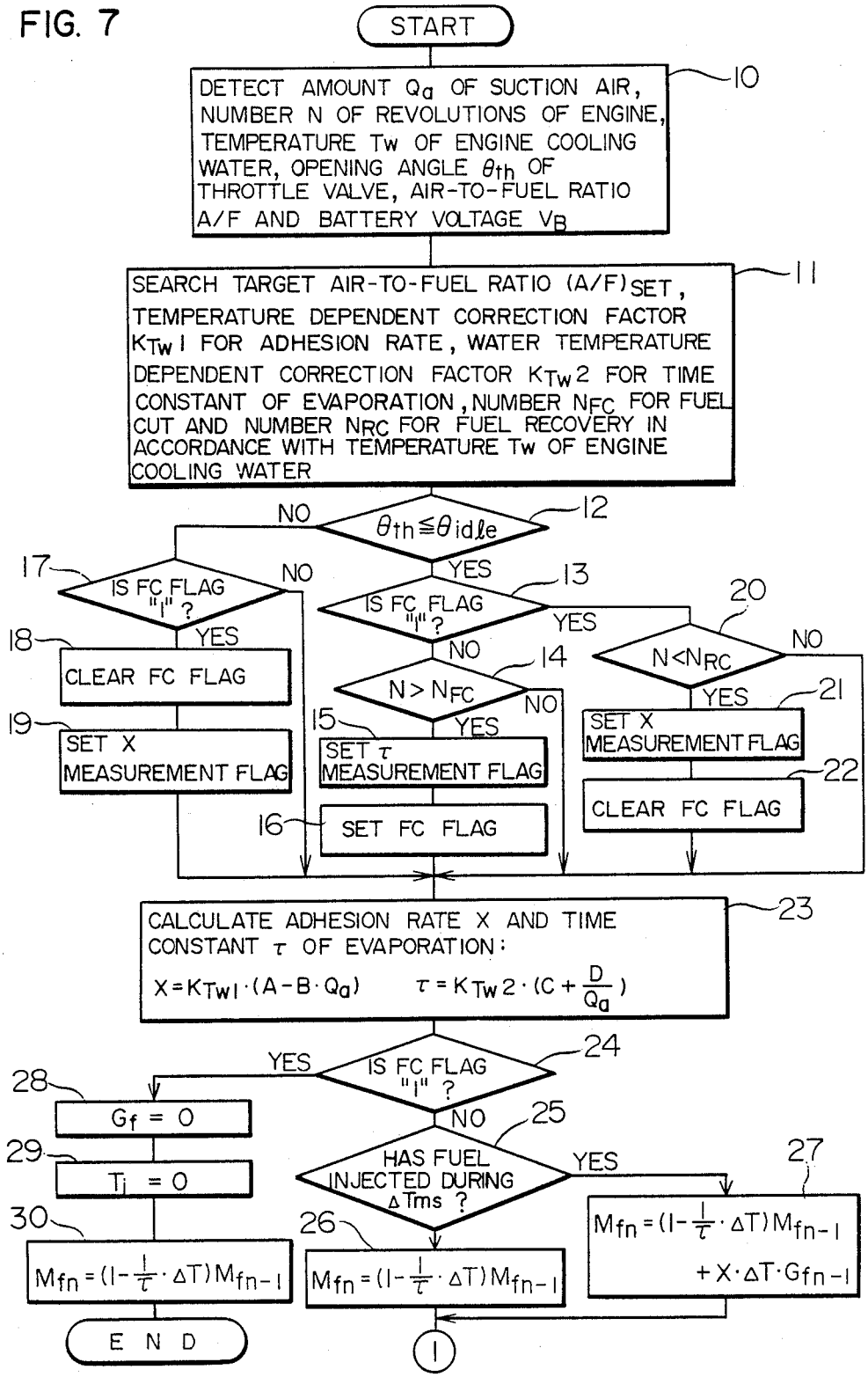
FIGS. 7 and 8 show as a whole a flow chart for explaining the operation of the embodiment of the present invention.
Figure 8:
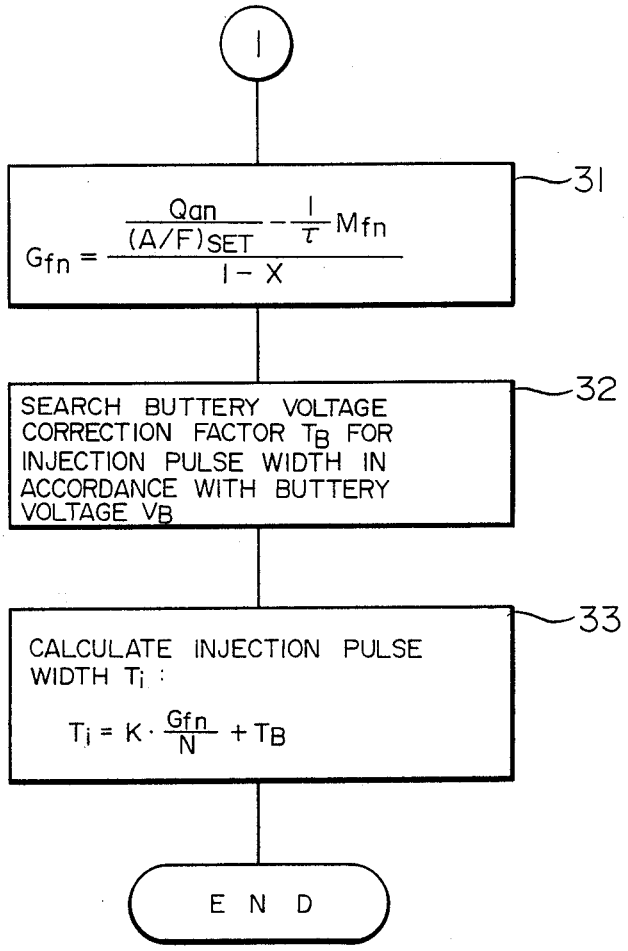

Next, an operation for determining the fuel injection pulse width $T_i$ on the basis of $X_O$ will be explained by virtue of a flow chart which is shown in FIGS. 7 and 8 as a whole.

The operation of control following this flow chart is activated for every predetermined period $\Delta T_{ms}$. In FIGS. 7 and 8, small characters (subscripts) n and n-1 are used for representing the latest data and data before $\Delta T_{ms}$, respectively.

First, in step 10, the amount $Q_a$ of suction air, the number N of revolutions of the engine, the temperature $T_W$ of engine cooling water, the opening angle $\theta_{th}$ of the throttle valve, the air-to-fuel ratio A/F and the battery voltage $V_B$ are detected. Next, in step 11, a target air-to-fuel ratio $(A/F)_{set}$, a water temperature dependent correction factor $K_{TW1}$ for adhesion rate, a water temperature dependent correction factor $K_{TW2}$ for time constant of evaporation, the number $N_{FC}$ of revolutions for fuel cut and the number $N_{RC}$ of revolutions for fuel recovery are searched in accordance with the detected temperature $T_W$ of engine cooling water.

In steps 12 to 19, the judgements of fuel cut and fuel recovery are made. In the case where a fuel cut condition of $\theta_{th} \leqq \theta_{idle}$ and $N > N_{FC}$ is satisfied, a $\tau$ measurement flag and a fuel cut (FC) flag are set in steps 15 and 16, respectively.

When the FC flag is set (or "1") and N is smaller than $N_{RC}$, an X measurement flag is set in step 21 and the FC flag is cleared in step 22.

When $\theta_{th}$ is larger than $\theta_{idle}$ and the FC flag is set (or "1"), the FC flag is cleared in step 18 and the X measurement flag is set in step 19.

Figure 9:
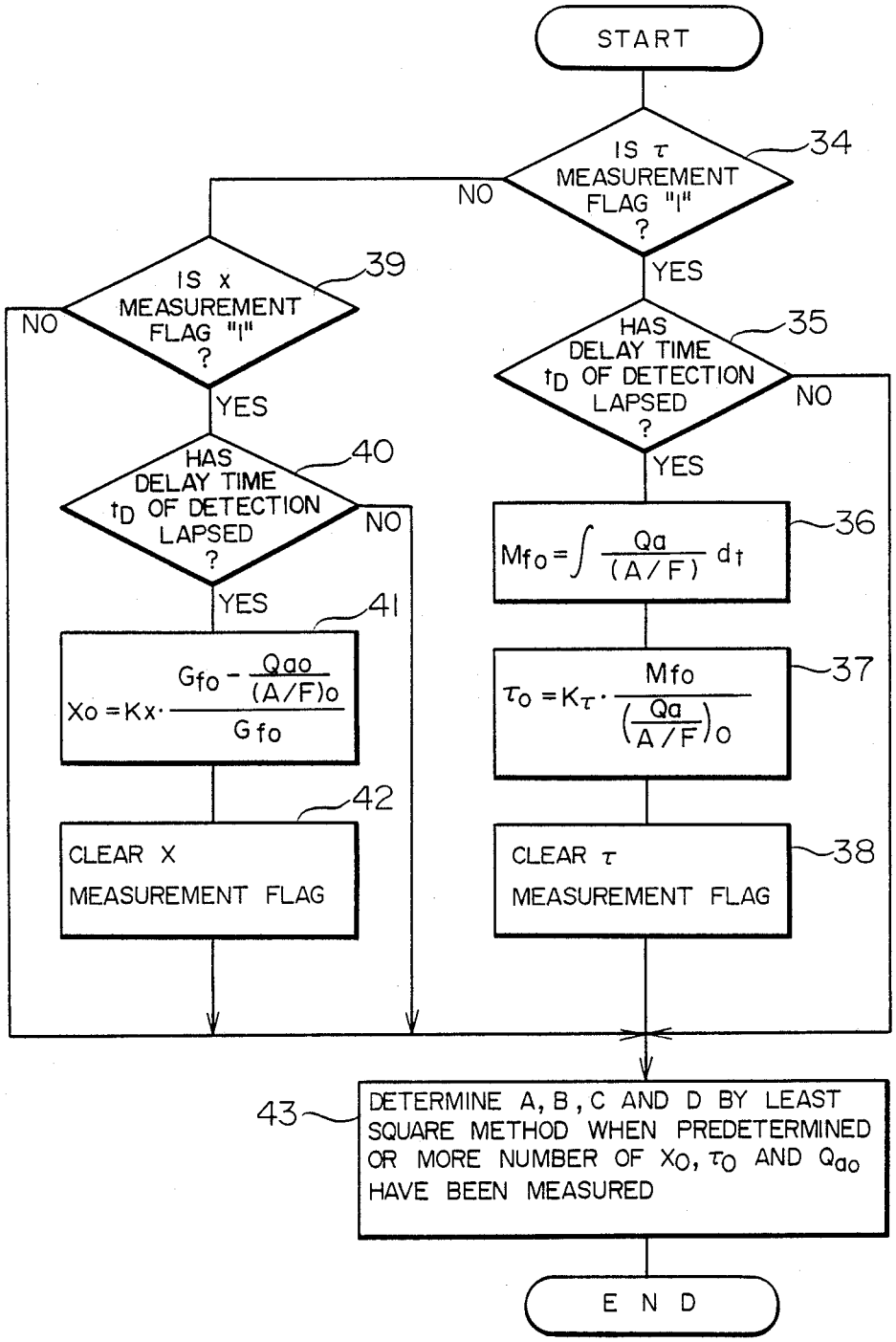
FIGS. 9 and 10 are flow charts showing different operations for determination of control factors.
Figure 10:
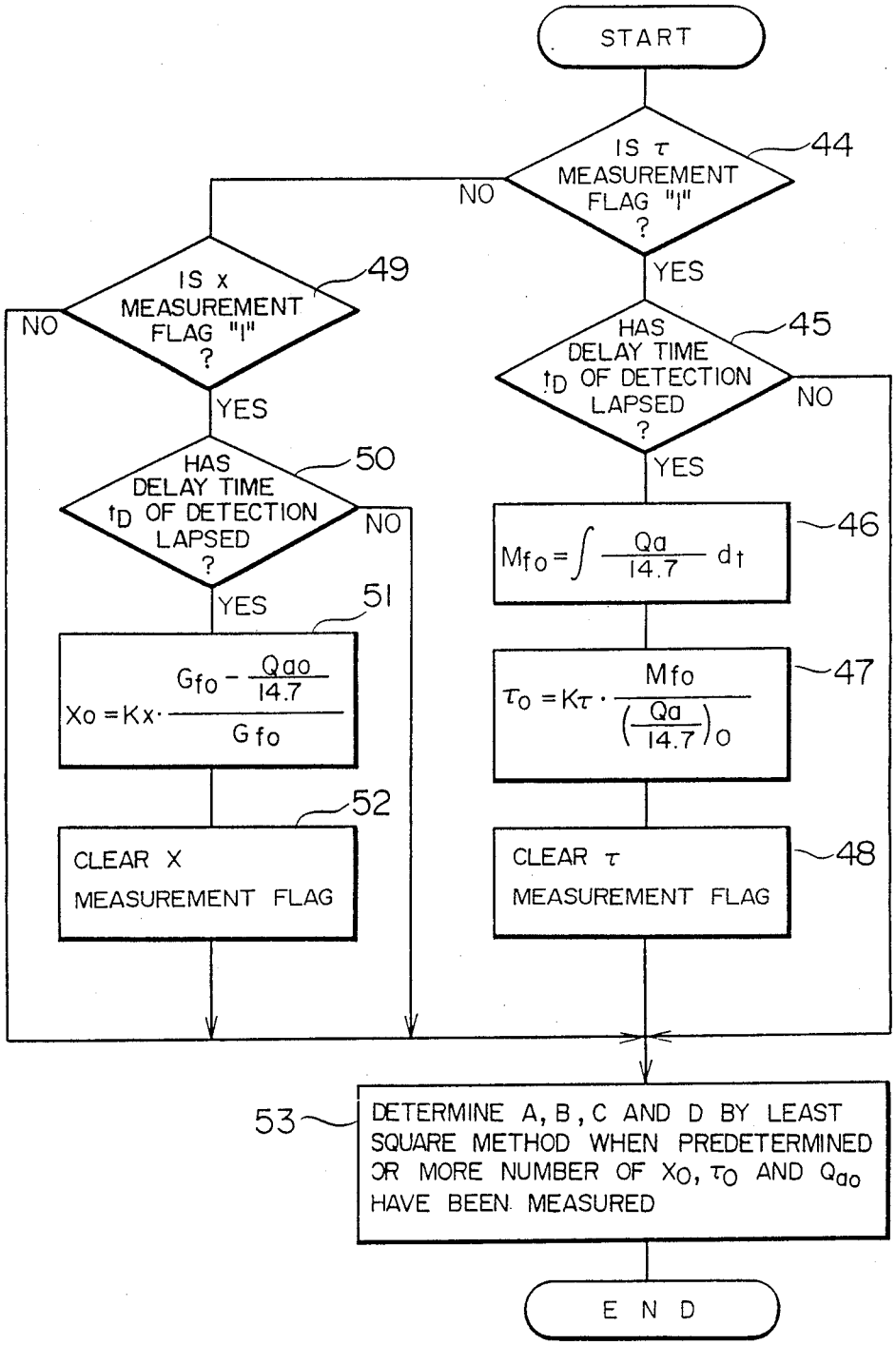

In step 23, the adhesion rate X and the time constant $\tau$ of evaporation are calculated on the basis of constants A, B, C and D which are determined by an operation following a flow chart shown in FIG. 9 or 10. In step 24, the judgement of whether or not the fuel cut (FC) flag is "1" is made. When the judgement is "YES", $G_f$ is set to be 0 in step 28, $T_i$ is set to be 0 in step 29 and the amount $M_f$ of liquid film is calculated in step 29, thereby completing the operation.

On the other hand, when the FC flag is not set or the judgement in step 24 is "NO", the judgement whether or not the fuel has been injected during $\Delta T_{ms}$ is made in step 25. In the case where the judgement in step 25 is "NO", the amount $M_f$ of liquid film is calculated in step 26. In the case where the judgement in step 25 is "YES", the calculation of the liquid film amount is made in step 27. Next, in step 31 of FIG. 8, the required or desired fuel amount $G_f$ is calculated. Subsequently, in step 32, the battery voltage dependent correction factor $T_B$ for injection pulse width is searched on the basis of the battery voltage $V_B$. Finally, in step 33, the injection pulse width $T_i$ is calculated, thereby completing the operation.

FIG. 9 is a flow chart showing a method of determining the constants A, B, C and D for X and $\tau$ in the case where an A/F sensor is used, and FIG. 10 is a similar flow chart in the case where an $O_2$ sensor is used. In FIG. 9, when the $\tau$ measurement flag is set and a delay time $t_D$ of detection by the A/F sensor has lapsed, the amount $M_{fO}$ of liquid film is determined in step 36 by integrating $Q_a/(A/F)$ until A/F has a lean value smaller than a predetermined value and the time constant $\tau_O$ of evaporation is determined in step 37. When the X measurement flag is set and the delay time $t_D$ of detection by the A/F sensor has lapsed, the adhesion rate $X_O$ is determined in step 41. The determination of $\tau_O$ and $X_O$ is made by using coefficients $K_X$ and $K_\tau$ while taking the output characteristic of the A/F sensor and the characteristic of detection of the amount of suction air into consideration. If a predetermined or more number of $X_O$ and $\tau_O$ are obtained, the operation proceeds to step 43 in which the constants A, B, C and D are determined on the basis of $X_O$, $\tau_O$ and $Q_a$.

On the other hand, in the flow chart of FIG. 10 in the case where the $O_2$ sensor is used, an integration in step 46 performed until the $O_2$ sensor signal changes from a rich condition to a lean condition. The determination of $\tau_O$ in step 47 is made using 14.7 as a representative value of A/F. The determination of $X_O$ in step 51 is made using the amount $G_{fO}$ of fuel and the amount $Q_{aO}$ upon change from the lean condition to the rich condition and using 14.7 as the value of A/F.

More especially, in the flow chart shown in FIG. 9, the judgement of whether or not the $\tau$ measurement flag is "1" is made in step 34 and the determination of whether or not the X measurement flag is "1" is made in step 39. The case where step 34 determines that the $\tau$ measurement flag is "1" corresponds to a state of fuel cut. In such a case, the time constant $\tau_O$ of evaporation is calculated in steps 35 to 38. In step 35, there is judged whether or not the delay time $t_D$ of detection has lapsed after the fuel cut. The delay time $t_D$ mainly depends on the characteristics of the suction and exhaust systems extending between the injector 7 and the A/F sensor 4. Though in the present embodiment the air-to-fuel ratio is measured by the A/F sensor, the fuel injected from the injector 7 does not reach the A/F sensor 4 in an instant. The injected fuel is sucked into the cylinder in which it is subjected to an explosion excusion, is issued into the exhaust pipe and thereafter reaches the A/F sensor. Accordingly, the calculation of the amount $M_{fO}$ of liquid film is to be made after the lapse of a predetermined delay time ($t_D$) of detection by the A/F sensor. In step 36, the amount $M_{fO}$ of liquid film is calculated. The calculation of the liquid film amount $M_{fO}$ is performed by integrating the amount $Q_a$ of suction air divided by the air-to-fuel ratio (A/F) over a predetermined time. In particular, the liquid film or fuel adhered to the intake tube is gradually sucked into the cylinder during the fuel cut. The amount of fuel sucked into the cylinder can be calculated on the basis of the amount of suction air and the air-to-fuel ratio. Therefore, the calculation of the liquid film amount is made in such a manner that the amount of fuel sucked into the cylinder is integrated until the output signal of the A/F sensor shows a sufficiently lean condition. The integration may be performed over a sufficient time from the fuel cut to the entire suction of the liquid film or adhered fuel into the cylinder. In step 37, the time constant $\tau_O$ of evaporation is calculated. The time constant of evaporation can be determined from the liquid film amount and (the amount of sucked air)/(the air-to-fuel ratio) on the basis of the above-mentioned mathematical model. The time constant $\tau_O$ of evaporation determined in step 37 is one corrected by a correction factor $K_\tau$. The correction factor $K_\tau$ mainly depends on the output characteristic of the A/F sensor and the characteristic of measurement (or detection) of the amount of suction air. After the calculation of the time constant $\tau_O$ of evaporation, the $\tau$ measurement flag is cleared in step 38 for the subsequent calculation. As the amount of liquid film may be used one calculated in accordance with step 26, 27 or 28 of FIG. 7.

The case where step 39 determines that the X measurement flag is "1" corresponds to a state of fuel recovery. In such a case, the adhesion rate $X_O$ is calculated in steps 40 to 42. In particular, step 40 judges whether or not the delay time $t_D$ of detection has lapsed after the fuel recovery. When $t_D$ has lapsed, the adhesion rate $X_O$ is calculated in step 41. The adhesion rate $X_O$ can be determined from the fuel supply amount $G_{fO}$, the amount $Q_{aO}$ of suction air, the air-to-fuel ratio A/F and a correction factor $K_X$ on the basis of the above-mentioned mathematical model. After the calculation of the adhesion rate $X_O$, the X measurement flag is cleared in step 42 for the subsequent calculation.

When the time constant $\tau_O$ of evaporation or the adhesion rate $X_O$ has been calculated in steps 34 to 42, the constants A, B, C and D used in step 23 of FIG. 7 are calculated in step 43. The time constant $\tau$ of evaporation and the adhesion rate X change depending on the amount of suction air. Namely, as the proportion of the amount of suction air to the amount of supplied fuel become higher, the speed of air flow becomes faster so that the amount of fuel sucked into the cylinder becomes corresponding more. Therefore, the adhesion rate X becomes less as the amount of sucked air becomes more. Accordingly, one can obtain the following approximate equation:

$$X = K_{TW1}(A - B \cdot Q_a)$$

In the present embodiment, the adhesion rate is primarily determined with respect to the amount of suction air by use of the above approximate equation. However, it is of course that another relation or equation may be used.

Also, as the amount of suction air becomes more, the amount of air passing over a surface of the liquid film (or adhered fuel) per unit time becomes more and hence the amount of evaporated liquid film (or fuel) becomes more. Further, the rate of evaporation greatly increases as the amount of suction air becomes more. Accordingly, one can obtain the following approximate equation:

$$\tau = K_{TW2}\left(C + \frac{D}{Q_a}\right).$$

The above approximate equations for the adhesion rate X and the time constant $\tau$ of evaporation have been confirmed by the present inventors' experiments.

In the flow chart shown in FIG. 10 in which the $O_2$ sensor is used, the case where step 44 determines that the $\tau$ measurement flag is "1" is a state in which the fuel cut is made. In that case, the time constant $\tau_O$ of evaporation is calculated in steps 45 to 47 on the basis of the above-mentioned mathematical model. In particular, when step 45 determines that the delay time $t_D$ of detection has lapsed after the fuel cut, the operation proceeds to step 46 in which the amount $M_{fO}$ of liquid film is calculated. The amount of liquid film can be obtained by determining the amount of fuel sucked into the cylinder on the basis of the amount of suction air and the air-to-fuel ratio and integrating the determined amount of sucked fuel over a predetermined time. Since the $O_2$ sensor is used, the judgement for the air-to-fuel ratio is possible only for whether the air-to-fuel ratio is rich or lean as compared with a theoretical value. In the case where the fuel cut is made, a negative pressure becomes very high since the throttle valve is in a state near its fully closed condition. Therefore, a substantial quantity of the liquid film or fuel adhered to the intake pipe is sucked into the cylinder so that the air-to-fuel ratio temporarily assumes a rich condition. Also, if the state of fuel cut is further continued, the amount of fuel sucked from the liquid film into the cylinder becomes less and hence the amount of air becomes relatively much so that the air-to-fuel ratio changes from the rich condition to a lean condition. During an interval of time from the rich condition to the lean condition, the air-to-fuel ratio can be regarded as being equal to 14.7 on an average. After the delay time $t_D$ of detection has lapsed, the amount $M_{fO}$ of liquid film is calculated in step 46 by integrating the amount of fuel sucked into the cylinder (approximated as $Q_a/14.7$) over the interval of time when the output signal of the $O_2$ sensor changes from the rich condition to the lean condition. In step 47, the time constant $\tau_O$ of evaporation is calculated on the basis of the above-mentioned mathematical model. In step 48, the $\tau$ measurement flag is cleared.

The case where step 49 determines that the X measurement flag is "1" corresponds to a state of fuel recovery. In that case, the adhesion rate $X_O$ is calculated in steps 50 and 51. In particular, when step 50 determines that the delay time $t_D$ of detection has lapsed from the fuel recovery, the calculation of the adhesion rate is made in step 51. Upon fuel recovery, since no fuel has been supplied into the cylinder before the fuel recovery, the air-to-fuel ratio takes a lean condition. After the fuel recovery has been initiated, the air-to-fuel ratio becomes rich. When the output signal of the $O_2$ sensor changes from the lean condition to the rich condition, the air-to-fuel ratio can be regarded as being equal to 14.7. In step 51, the adhesion rate $X_O$ is calculated on the basis of the above-mentioned mathematical model by use of the values of the amount $Q_{aO}$ of suction air and the fuel supply amount $G_{fO}$ when the change from the lean condition to the rich condition occurs. In step 52, the X measurement flag is cleared.

According to the disclosed embodiments, a change of the fuel supply amount in a transient state can be determined with a high precision, which makes it possible to perform always an accurate A/F control.

As is apparent from the foregoing, according to the present invention, since the fuel adhesion rate and the time constant of evaporation of fuel are determined from the change of A/F upon fuel cut and the change of A/F upon fuel recovery thereafter, there is provided an effect that the preestimation of the fuel supply amount can be made quantitatively and hence an A/F control in a transient state can be performed with a high precision, which suppresses any variation in A/F, thereby greatly improving the controllability of driving and sufficiently suppressing the deflation of deteriorated exhaust gas.

We claim:

1. An engine control apparatus comprising detecting means for detecting a condition of an engine, operation means for determining the adhesion rate of fuel and the time constant of evaporation of fuel in a fuel injection and suction system in a preestimating manner and determining the amount of fuel to be supplied on the basis of said adhesion rate, said time constant of evaporation and the condition of the engine detected by said detecting means, and fuel supply means for supplying fuel in accordance with the determined fuel supply amount, in which said operation means includes first operation means for calculating said time constant of evaporation on the basis of the amount of liquid film and the amount of fuel sucked into a cylinder after a fuel cut and calculating said adhesion rate on the basis of the amount of supply of fuel and the amount of fuel sucked into the cylinder after a fuel recovery.

2. An engine control apparatus according to claim 1, wherein said operation means includes second operation means for determining said amount of liquid film and said amount of fuel sucked into the cylinder on the basis of the amount of suction air and an air-to-fuel ratio.

3. An engine control apparatus according to claim 1, wherein said operation means includes correcting means for correcting said time constant of evaporation and said adhesion rate with correction factors which depend on the physical property of a fuel supply system.

4. An engine control apparatus according to claim 2, wherein said operation means includes integrating means for integrating, a value obtained on the basis of the amount of suction air and the air-to-fuel ratio, over a predetermined time, thereby determining said amount of liquid film.

5. An engine control apparatus according to claim 2, wherein said operation means includes calculation start indicating means for generating a signal indicative of the start of calculation of said adhesion rate or said amount of liquid film after a predetermined time has lapsed after the fuel cut or the fuel recovery.

6. An engine control apparatus according to claim 1, wherein said operation means includes function determining means for determining a function of the amount of suction air in which at least one constant defined on the basis of said time constant of evaporation and said adhesion rate is used, and third operation means for determining a correction value for the fuel supply amount on the basis of said function and the amount of suction air.

7. An engine control apparatus according to claim 6, wherein said operation means includes correcting means for correcting said time constant of evaporation and said adhesion rate on the basis of correction factors each of which is a function of temperature.

8. An engine control apparatus comprising detecting means for detecting a condition of an engine, operation means for determining the adhesion rate of fuel and the time constant of evaporation of fuel in a fuel injection and suction system in a pre-estimating manner and determining the amount of fuel to be supplied on the basis of said adhesion rate, said time constant of evaporation and the condition of the engine detected by said detecting means; and fuel supply means for supplying in accordance with the determined fuel supply amount; in which said operation means includes first means for calculating the amount of fuel in a liquid film adhering in said fuel injection and suction system on the basis of the amount of fuel sucked into a cylinder of the engine during a selected time period after a fuel cut, and second means for calculating the time constant of evaporation on the basis of said amount of fuel in the liquid film and conditions of the engine detected by said detecting means.

9. An engine control apparatus according to claim 8, wherein said first means includes integrating means for integrating a value obtained on the basis of an amount of suction air and air-to-fuel ratio detected by said detecting means over a predetermined time following fuel cut to determine said amount of fuel in the liquid film.

10. An engine control apparatus according to claim 8, wherein said operation means includes calculation start indicating means for initiating operation of said first means a predetermined time after fuel cut.

11. An engine control apparatus according to claim 8, wherein said operation means further includes means for storing values of said time constant of evaporation for respective values of a predetermined engine operating condition, function determining means for determining a function of said time constant of evaporation for respective values of said predetermined engine operating condition, and means for updating values of said time constant of evaporation in said storing means in response to the values of time constant of evaporation calculated by said second means of said function.

12. An engine control apparatus according to claim 11, wherein said operation means further includes correcting means for correcting said values of time constant of evaporation on the basis of correction factors which are a function of engine temperature.

13. An engine control apparatus according to claim 11, wherein said predetermined engine operating condition is amount of suction air.

14. An engine control apparatus according to claim 8, wherein said operation means further includes function determining means for determining a function of said time constant of evaporation for respective values of a predetermined engine operating condition, and means for determining a correction value for the fuel supply amount on the basis of said function and said predetermined engine operating condition.

15. An engine control apparatus according to claim 14, wherein said operation means further includes correcting means for correcting said values of time constant of evaporation on the basis of correction factors which are a function of engine temperature.

16. An engine control apparatus according to claims 14, wherein said predetermined engine operating condition is amount of suction air.

17. An engine control apparatus comprising detecting means for detecting a condition of an engine, operation means for determining the adhesion rate of fuel and the time constant of evaporation of fuel in a fuel injection and suction system in a pre-estimating manner and determining the amount of fuel to be supplied on the basis of said adhesion rate, said time constant of evaporation and the condition of the engine detected by said detecting means, and fuel supply means for supplying fuel in accordance with the determined fuel supply amount, in which said operation means includes first means for calculating the amount of fuel sucked into a cylinder of the engine during a selected time period after fuel recovery following fuel cut or reacceleration following deceleration, and second means for calculating the adhesion rate on the basis of said amount of fuel calculated by said first means and conditions of the engine detected by said detecting means.

18. An engine control apparatus according to claim 17, wherein said first means includes means for calculating a value obtained on the basis of an amount of suction air and air-to-fuel ratio detected by said detecting means at a time after final recovery following fuel cut or reacceleration following deceleration and means for determining said adhesion rate on the basis of said calculated value and said determined fuel supply amount at said time.

19. An engine control apparatus according to claim 18, wherein said operation includes calculation start indicating means for generating a signal indicative of the start of calculation of said adhesion rate after a predetermined time has lapsed after fuel recovery.

20. An engine control apparatus according to claim 17, wherein said operation means further includes means for storing values of said adhesion rate for respective values of a predetermined engine operating condition, function determining means for determining a function of said adhesion rate for respective values of said predetermined engine operating condition, and means for updating values of said adhesion rate in said storing means in response to the values of adhesion rate calculated by said second means and said function.

21. An engine control apparatus according to claim 20, wherein said operation means further includes correcting means for correcting said values of adhesion rate on the basis of correction factors which are a function of engine temperature.

22. An engine control apparatus according to claim 20, wherein said predetermined engine operating condition is amount of suction air.

23. An engine control apparatus according to claim 17, wherein said operation means further includes function determining means for determining a function of said adhesion rate for respective values of a predetermined engine operating condition, and means for determining a correction value for the fuel supply amount on the basis of said function and said predetermined engine operating condition.

24. An engine control apparatus according to claim 23, wherein said operation means further includes function determining means for determining a function of said adhesion rate for respective values of a predetermined engine operating condition, and means for determining a correction value for the fuel supply amount on the basis of said function and said predetermined engine operating condition.

25. An engine control apparatus according to claim 23, wherein said predetermined engine operating condition is amount of suction air.

* * * * *